US006148701A

United States Patent [19]

Lee

[11] Patent Number: 6,148,701

[45] Date of Patent: Nov. 21, 2000

[54] TOOL HANDLE WITH HIGH DRIVING TORQUE

[76] Inventor: Shu-Chen Lee, 3F, No. 1, Alley 3, Lane 80, Min-Sheng East Road, Section 4, Taipei, Taiwan

[21] Appl. No.: 09/379,400

[22] Filed: Aug. 24, 1999

[51] Int. Cl.[7] ..... B25G 1/01

[52] U.S. Cl. ..... 81/489; 81/177.1

[58] Field of Search ..... 81/489, 177.1, 81/492, 58, 427.5; 16/110 R, 430, DIG. 12, DIG. 18

[56] References Cited

U.S. PATENT DOCUMENTS

| | | | |
|---|---|---|---|
| D. 28,230 | 2/1898 | Swan | 81/177.1 |
| 1,975,343 | 10/1934 | Zygmunt | 145/61 |
| 3,592,247 | 7/1971 | Solf | 145/61 |
| 5,390,572 | 2/1995 | Gakhar et al. | 81/436 |
| 5,475,894 | 12/1995 | Wildforster | 16/111 R |
| 5,551,323 | 9/1996 | Beere et al. | 81/489 |

*Primary Examiner*—Timothy V. Eley
*Assistant Examiner*—Dung Van Nguyen
*Attorney, Agent, or Firm*—Alan Kamrath

[57] ABSTRACT

A tool handle includes a polygonal first end and a rectangular second end adapted to engage with a tool bit. The first end has a plurality of spaced first arcuate corner sections. The second end has a plurality of spaced second arcuate corner sections. Each first arcuate corner section of the first end is connected via a skew connecting face to an associated arcuate corner section of the second end. A skew recessed area is formed between each two adjacent said connecting faces.

16 Claims, 10 Drawing Sheets

TOOL HANDLE WITH HIGH DRIVING TORQUE

BACKGROUND OF THE INVENTION

1. Field of the Invention

The present invention relates to a handle for handle tools (e.g., screwdrivers), and more particularly to a tool handle having high driving torque.

2. Description of the Related Art

FIG. 1 of the drawings illustrates a screwdriver with a conventional handle. Although many efforts have been made to find a handle with easy-to-grip feature, the result is still unsatisfactory. The user still has to apply a relatively large force to drive the fastener and the friction effect between the user's hand and the handle is somewhat unacceptable.

The present invention is intended to provide a handle that mitigates and/or obviates the above problems.

SUMMARY OF THE INVENTION

It is a primary object of the present invention to provide a high driving torque handle that allows easy grip for the user.

A tool handle in accordance with the present invention comprises a polygonal first end and a rectangular second end adapted to engage with a tool bit. The first end has a plurality of spaced first arcuate corner sections. The second end has a plurality of spaced second arcuate corner sections. Each first arcuate corner section of the first end is connected via a skew connecting face to an associated arcuate corner section of the second end. A skew recessed area is formed between each two adjacent said connecting faces.

Each skew recessed section may include an anti-slip means provided therein for providing improved friction between the user's hand and the tool handle. In an embodiment of the invention, the anti-slip means includes a plurality of knurls.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
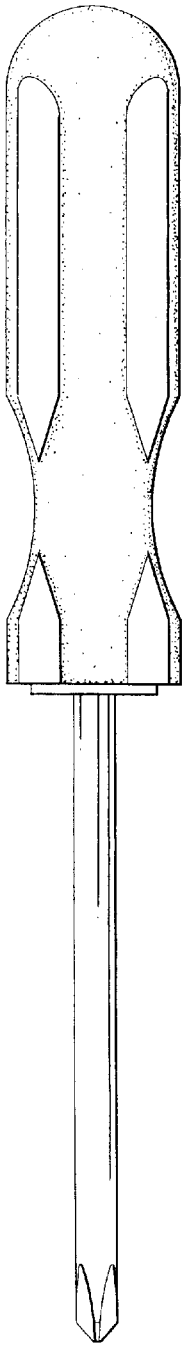
Fig. 1 PRIOR ART
FIG. 1 is a perspective view of a conventional screwdriver.
Figure 2:
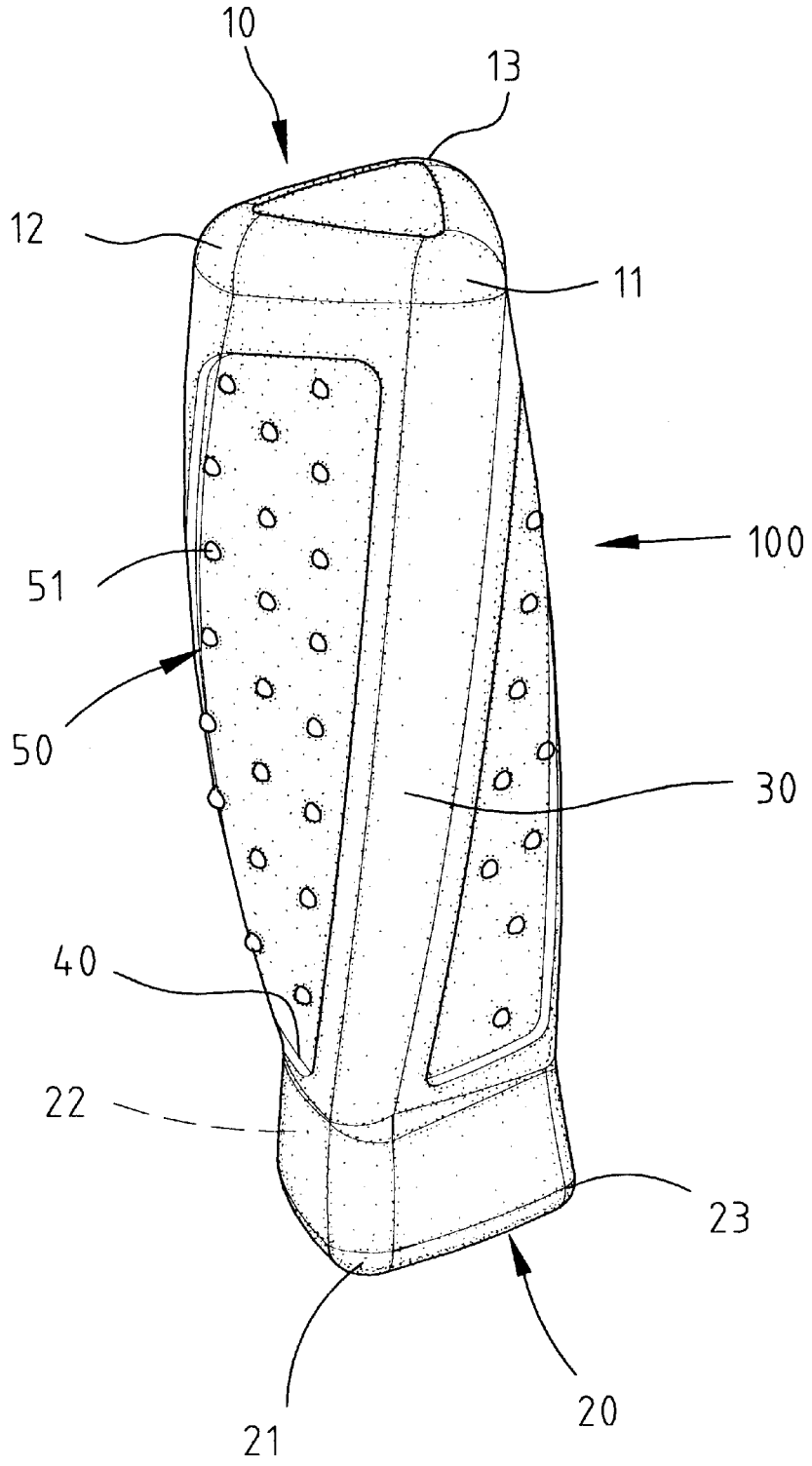
FIG. 2 is a perspective view of a tool handle in accordance with the present invention.

Referring to FIG. 2, a tool handle 100 in accordance with the present invention generally includes a polygonal first end 10 and a polygonal second end 20 adapted to engage with a tool bit (e.g., a cabinet tip or Phillips head tip). In this embodiment, the first end 10 is substantially triangular and has three spaced arcuate corner sections 11, 12, and 13. Similarly, the second end 20 is substantially triangular and includes three spaced arcuate corner sections 21, 22, and 23. Each arcuate corner section 11, 12, 13 of the first end 10 is connected via a skew connecting face 30 to an associated arcuate corner section 21, 22, 23 of the second end 20 that is not aligned with the arcuate corner section 11, 12, 13. In this embodiment, the arcuate corner section 11, 12, 13 and the arcuate corner section 21, 22, 23 connected to the corner section 11, 12, 13 have a 60° difference in their locations. A skew recessed area 40 is formed between each two adjacent connecting faces 30. An anti-slip means 50 in the form of knurls 51 are provided in each recessed area 40 for providing improved friction between the user's hand and the handle 100.

Figure 3:
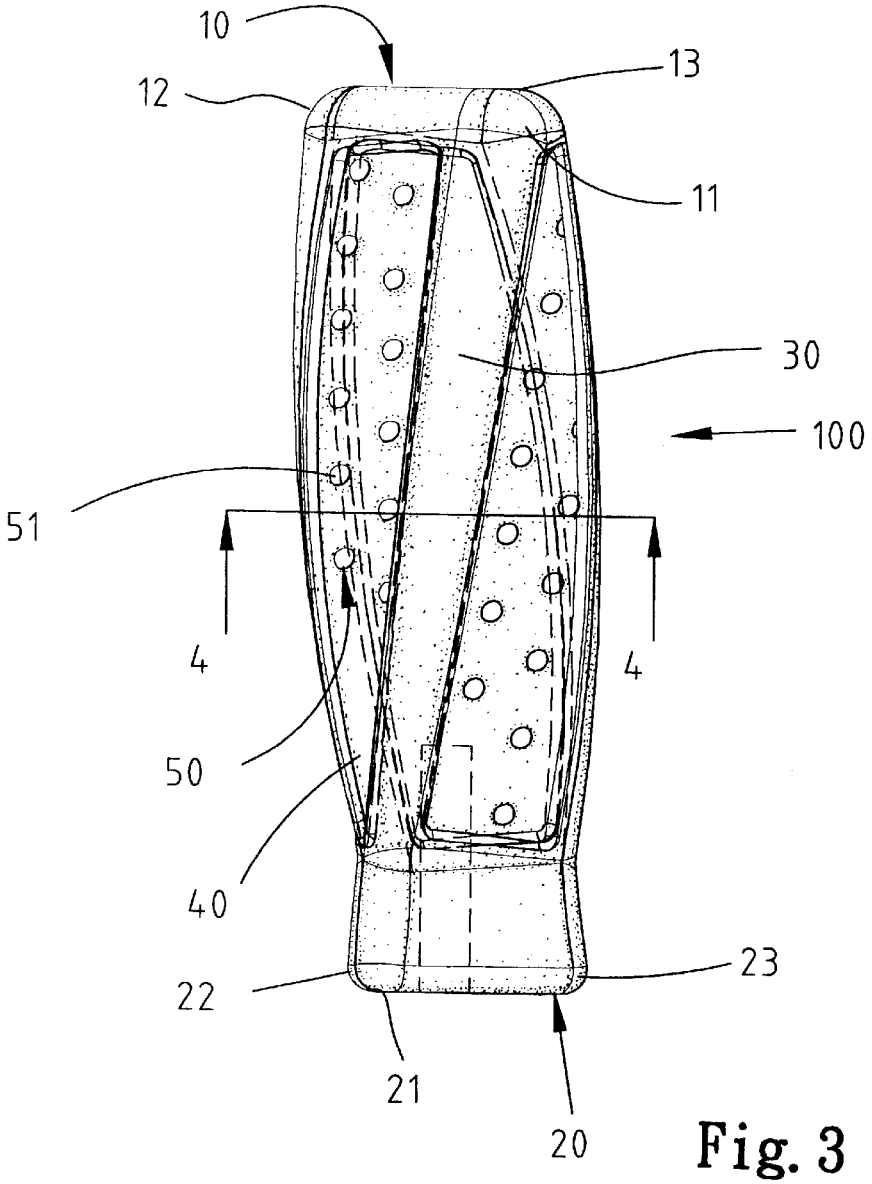
FIG. 3 is a front elevational view of the tool handle in FIG. 2.
Figure 4:
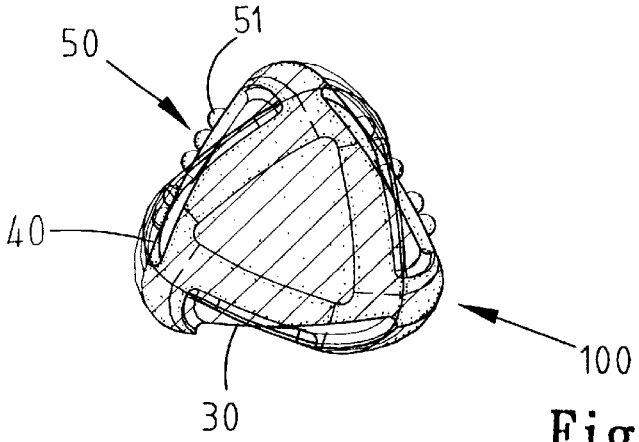
FIG. 4 is a sectional view taken alone line 4—4 in FIG. 3.
Figure 5:
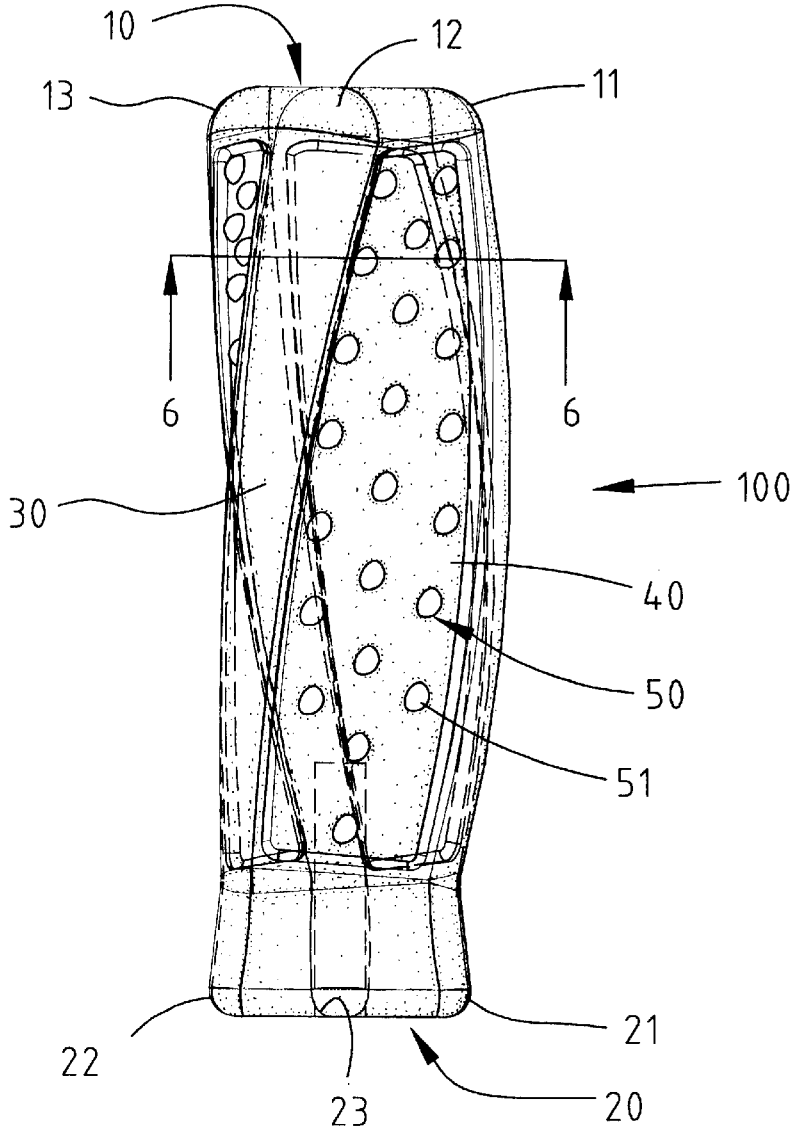
FIG. 5 is a left side elevational view of the tool handle in FIG. 2.
Figure 6:
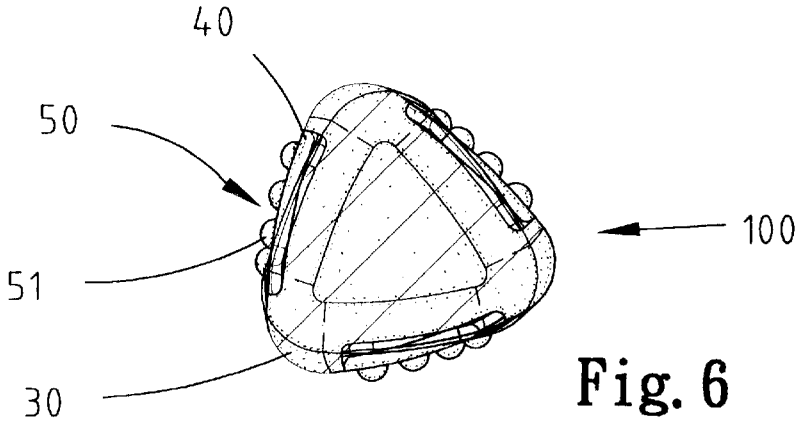
FIG. 6 is a sectional view taken alone line 6—6 in FIG. 5.
Figure 7:
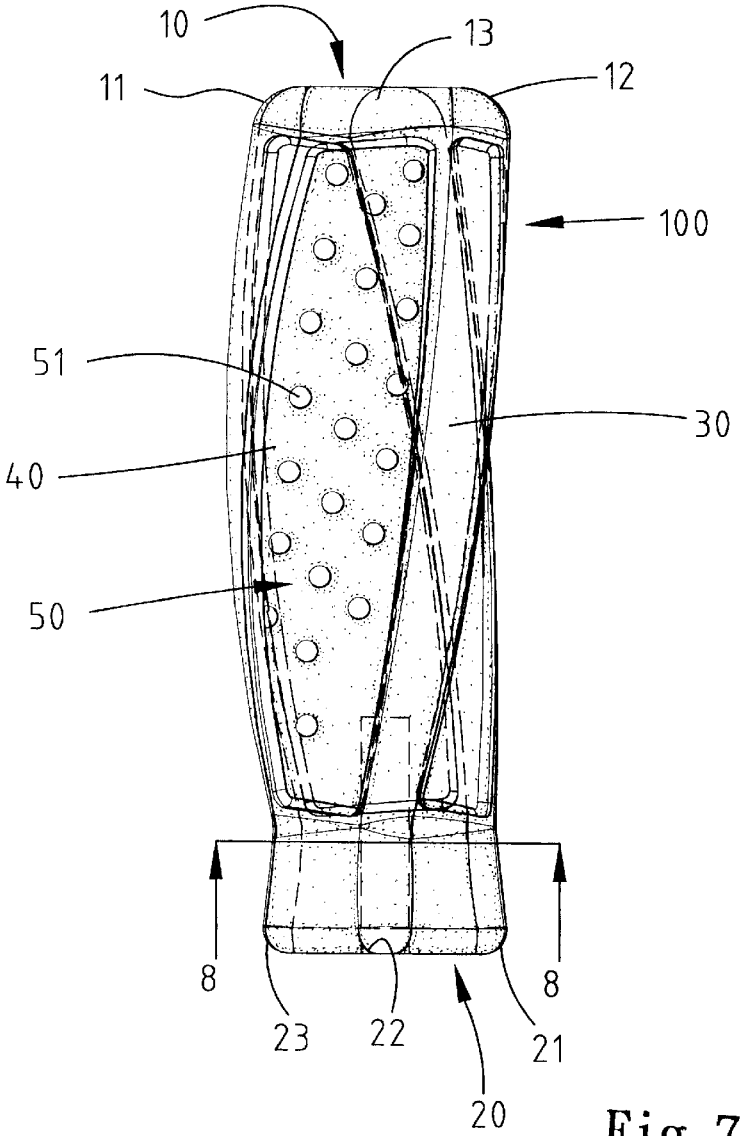
FIG. 7 is a right side elevational view of the tool handle in FIG. 2.
Figure 8:
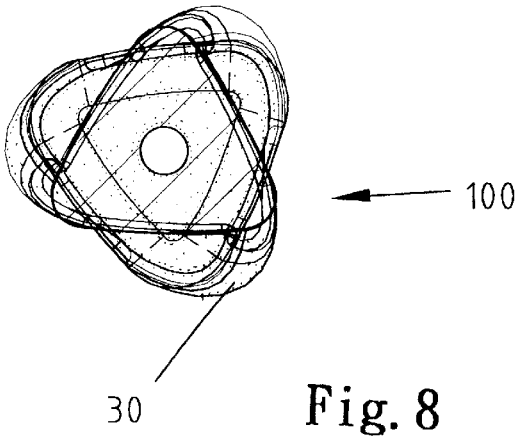
FIG. 8 is a sectional view taken alone line 8—8 in FIG. 7.
Figure 9:
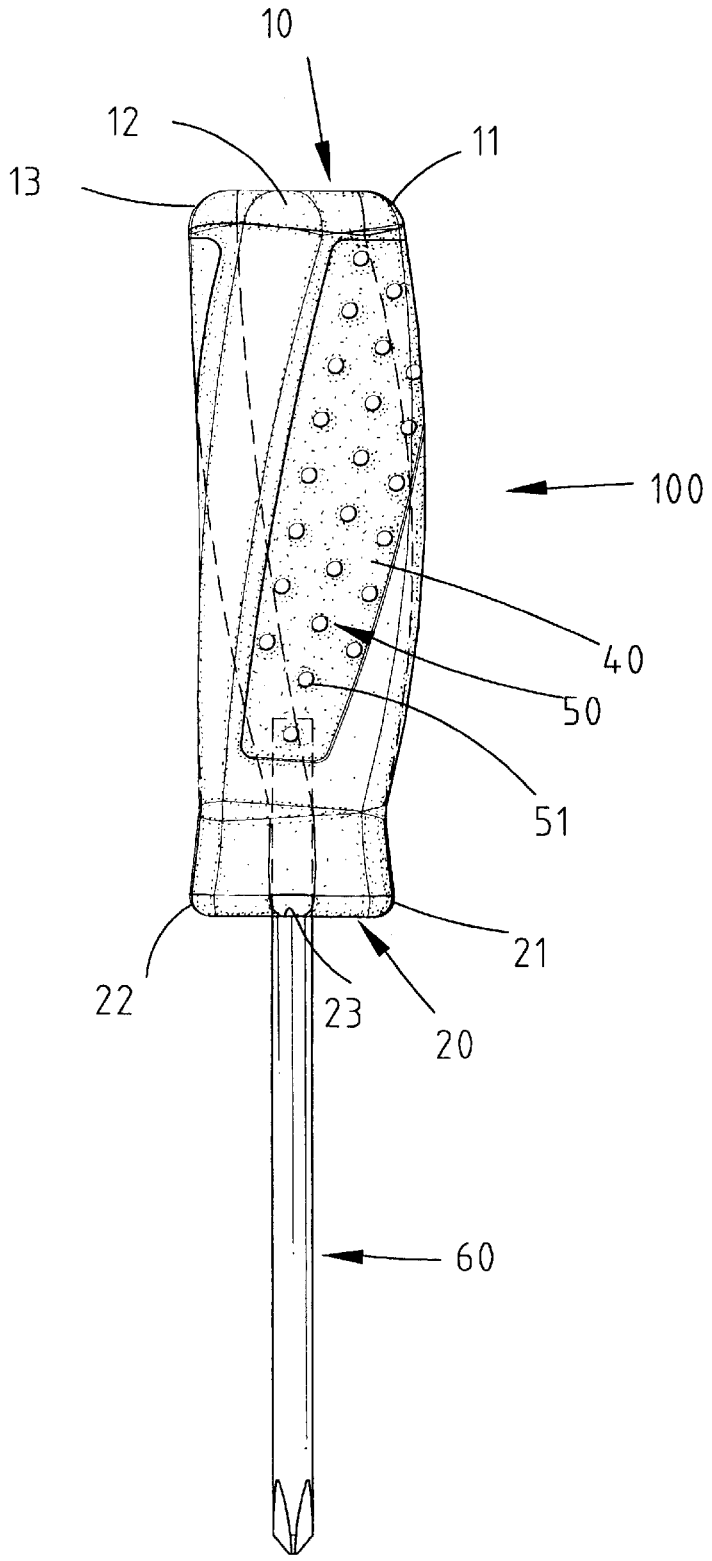
FIG. 9 is a perspective view of the tool handle of the present invention applied to a screwdriver.
Figure 10:
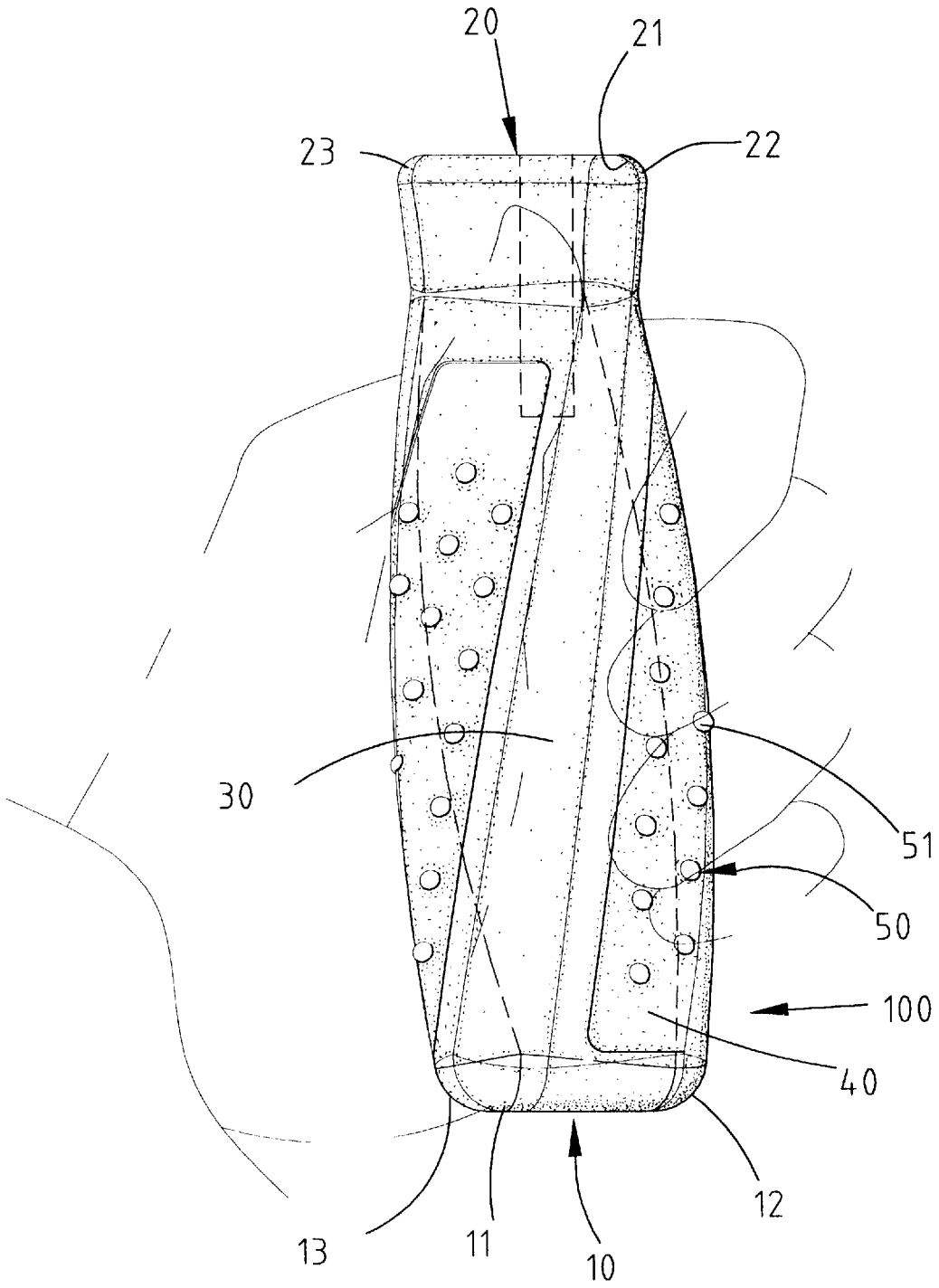
FIG. 10 is a front view of the tool handle when grasped by a left hand.
Figure 11:
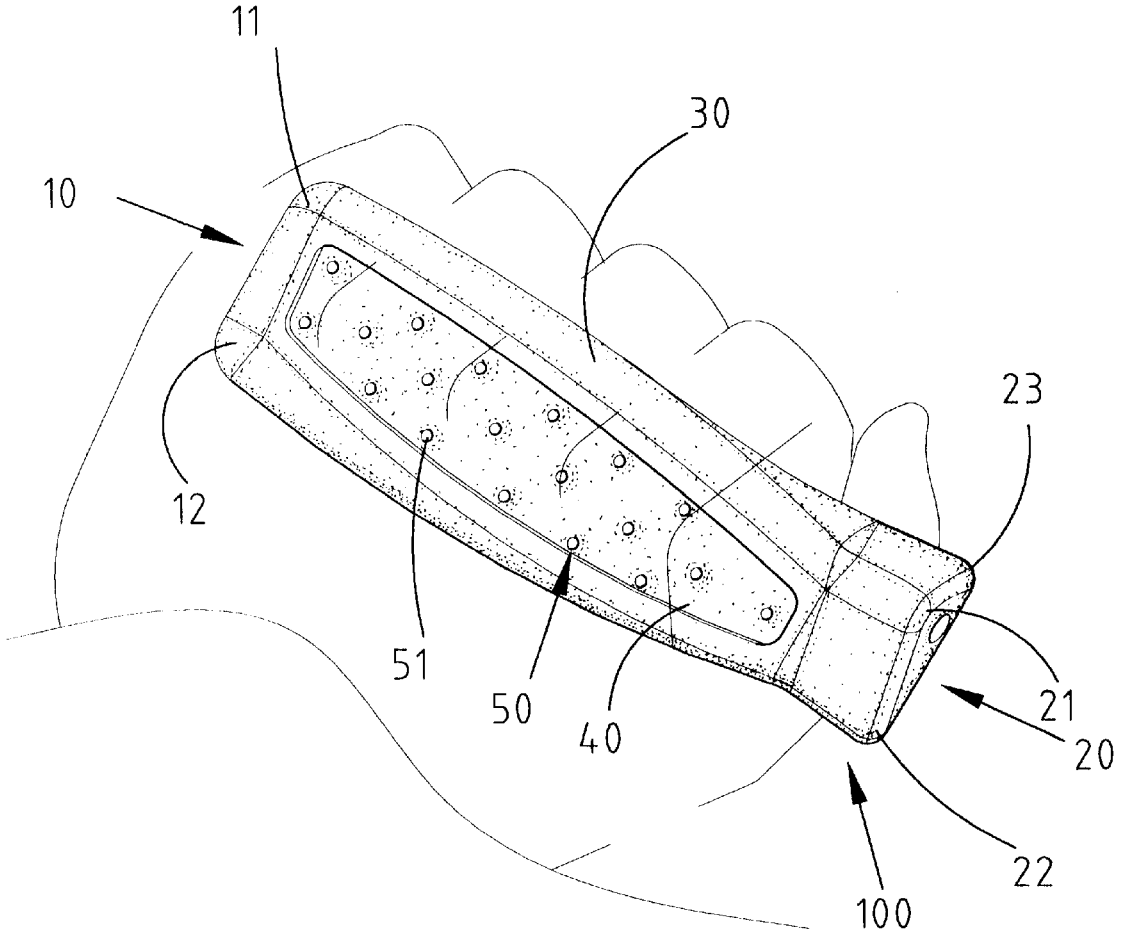
FIG. 11 is a perspective view of the tool handle when grasped by a left hand in an inclined status.
Figure 12:
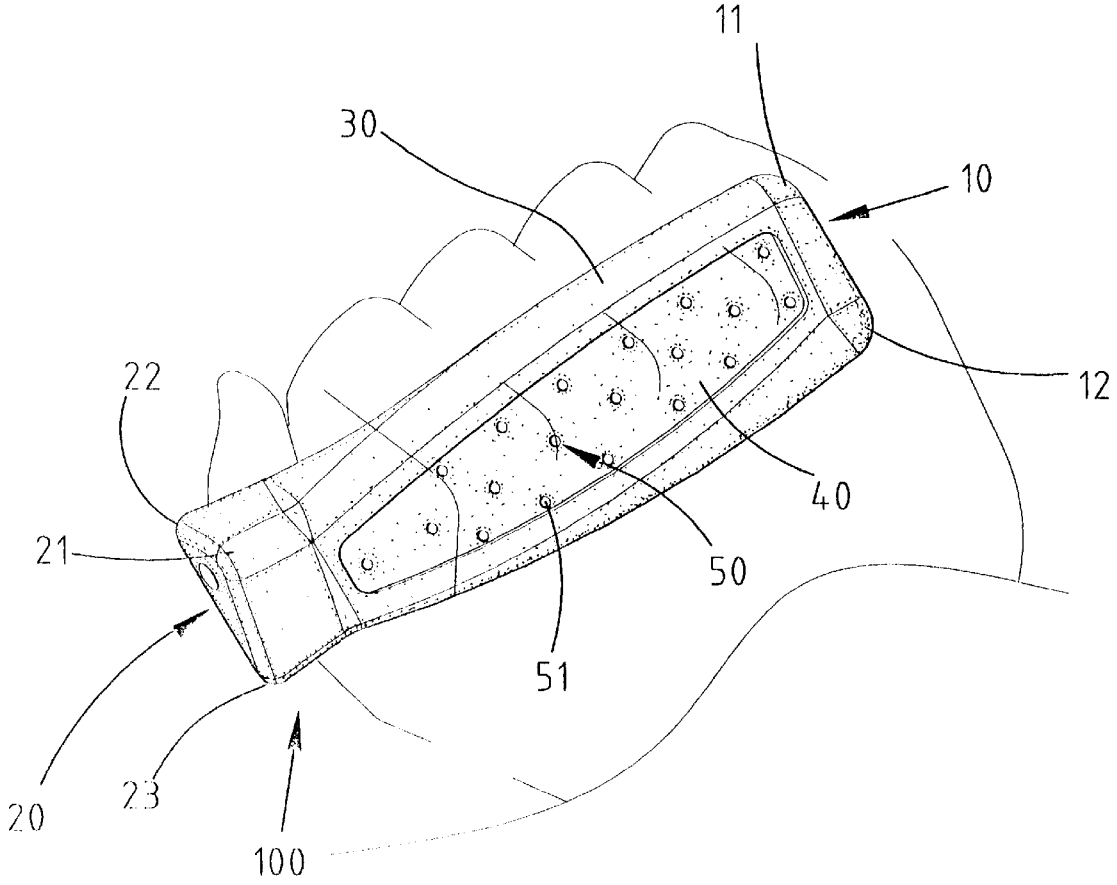
FIG. 12 is a perspective view of the tool handle when grasped by a right hand in an inclined status.

FIG. 3 is a front elevational view of the tool handle in FIG. 2. FIG. 4 is a sectional view taken alone line 4—4 in FIG. 3. FIG. 5 is a left side elevational view of the tool handle in FIG. 2. FIG. 6 is a sectional view taken alone line 6—6 in FIG. 5. FIG. 7 is a right side elevational view of the tool handle in FIG. 2. FIG. 8 is a sectional view taken alone line 8—8 in FIG. 7. All of the drawings illustrate the skew configuration of the recessed areas 40 and the connecting faces FIG. 9 illustrates application of the tool handle of the invention to a screwdriver 60. FIGS. 10 and 11 illustrate grasp of the tool handle by a left hand, and FIG. 12 illustrates grasp of the tool handle by a right hand. It is appreciated that the user has to twist the tool handle when driving a fastener. The skew arrangement of the tool handle allows the user to firmly grasp the tool handle during the twisting movement. Thus, a higher driving torque can be obtained while having a firm grasp of the tool handle by the user's hand.

Figure 13:
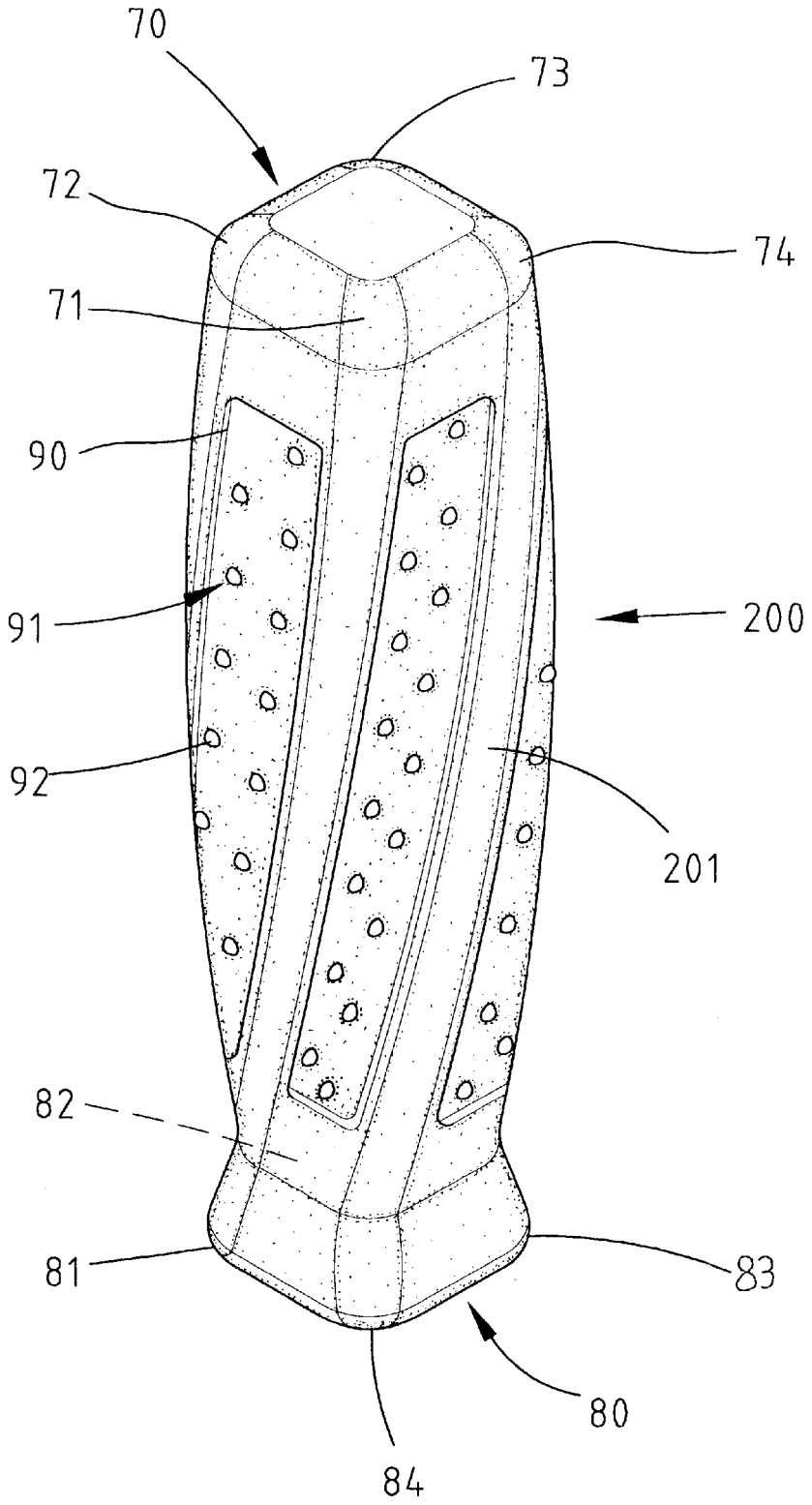
FIG. 13 is a perspective view of another embodiment of the tool handle in accordance with the present invention.

FIG. 13 illustrates a modified tool handle 200 in accordance with the present invention that generally includes a rectangular first end 70 and a rectangular second end 80 adapted to engage with a tool bit (e.g., a cabinet tip or Phillips head tip). In this embodiment, the first end 70 has four spaced arcuate corner sections 71, 72, 73, and 74. Similarly, the second end 80 has four spaced arcuate corner sections 81, 82, 83, and 84. Each arcuate corner section 71, 72, 73, 74 of the first end 70 is connected via a skew connecting face 201 to an associated arcuate corner section 81, 82, 83, 84 of the second end 80. A skew recessed area 90 is formed between each two adjacent connecting faces 201. An anti-slip means 91 in the form of knurls 92 are provided in each recessed area 90 for providing improved friction between the user's hand and the handle 200. Operation of this embodiment is identical to that of the first embodiment.

According to the above description, it is appreciated that the tool handle of the invention provides a reliable grasp for the user's hand and higher driving torque.

Although the invention has been explained in relation to its preferred embodiment, it is to be understood that many other possible modifications and variations can be made without departing from the spirit and scope of the invention as hereinafter claimed.

What is claimed is:

1. A tool handle comprising a polygonal first end and a polygonal second end adapted to engage with a tool bit, the first end having a plurality of spaced first arcuate corner sections, the second end having a plurality of spaced second arcuate corner sections, each said first arcuate corner section of the first end being connected via a skew connecting face to an associated said arcuate corner section of the second end, a skew recessed area being formed between each two adjacent said connecting faces.

2. The tool handle as claimed in claim 1, wherein each said skew recessed section includes an anti-slip means provided therein for providing improved friction between the user's hand and the tool handle.

3. The tool handle as claimed in claim 2, wherein the anti-slip means includes a plurality of knurls.

4. The tool handle as claimed in claim 3, wherein the first end and the second end are substantially triangular.

5. The tool handle as claimed in claim 4, wherein the knurls have an outer extent greater than a line extending between two adjacent said connecting faces.

6. The tool handle as claimed in claim 5, wherein the antislip means comprises a mat of a size for receipt in the skew recessed section and of a thickness generally equal to a depth of the skew recessed section, with the plurality of knurls being integrally formed and extending from the mat.

7. The tool handle as claimed in claim 4, wherein the antislip means comprises a mat of a size for receipt in the skew recessed section and of a thickness generally equal to a depth of the skew recessed section, with the plurality of knurls being integrally formed and extending from the mat.

8. The tool handle as claimed in claim 3, wherein the antislip means comprises a mat of a size for receipt in the skew recessed section and of a thickness generally equal to a depth of the skew recessed section, with the plurality of knurls being integrally formed and extending from the mat.

9. The tool handle as claimed in claim 3, wherein the first end and the second end are rectangular.

10. The tool handle as claimed in claim 9, wherein the knurls have an outer extent greater than a line extending between two adjacent said connecting faces.

11. The tool handle as claimed in claim 10, wherein the antislip means comprises a mat of a size for receipt in the skew recessed section and of a thickness generally equal to a depth of the skew recessed section, with the plurality of knurls being integrally formed and extending from the mat.

12. The tool handle as claimed in claim 9, wherein the antislip means comprises a mat of a size for receipt in the skew recessed section and of a thickness generally equal to a depth of the skew recessed section, with the plurality of knurls being integrally formed and extending from the mat.

13. The tool handle as claimed in claim 3, wherein the knurls have an outer extent greater than a line extending between two adjacent said connecting faces.

14. The tool handle as claimed in claim 13, wherein the antislip means comprises a mat of a size for receipt in the skew recessed section and of a thickness generally equal to a depth of the skew recessed section, with the plurality of knurls being integrally formed and extending from the mat.

15. The tool handle as claimed in claim 1, wherein the first end and the second end are substantially triangular.

16. The tool handle as claimed in claim 1, wherein the first end and the second end are rectangular.

* * * * *